US010236567B2

(12) United States Patent
Neal

(10) Patent No.: US 10,236,567 B2
(45) **Date of Patent: *Mar. 19, 2019**

(54) THIRD BRAKE LIGHT ANTENNA MOUNT

(71) Applicant: Neal Technologies Inc., Mesa, AZ (US)

(72) Inventor: Kennieth Neal, Mesa, AZ (US)

(73) Assignee: Neal Technologies, Inc., Mesa, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/136,089

(22) Filed: Sep. 19, 2018

(65) Prior Publication Data

US 2019/0020103 A1 Jan. 17, 2019

Related U.S. Application Data

(63) Continuation of application No. 15/182,809, filed on Jun. 15, 2016, now Pat. No. 10,090,583.

(60) Provisional application No. 62/182,328, filed on Jun. 19, 2015.

(51) Int. Cl.
*H01Q 1/32* (2006.01)
*H01Q 1/50* (2006.01)

(52) U.S. Cl.
CPC ..... *H01Q 1/3275* (2013.01); *H01Q 1/50* (2013.01)

(58) Field of Classification Search
CPC ..... H01Q 1/3275; H01Q 1/50; H01Q 1/325; B60R 2011/004; B60R 2011/0052; B60R 2011/0066
USPC ..... 343/712, 713
See application file for complete search history.

(56) References Cited

U.S. PATENT DOCUMENTS

| | | | | | |
|---|---|---|---|---|---|
| 4,103,305 | A * | 7/1978 | Gualano | H01Q 1/084 | 343/715 |
| 4,114,160 | A * | 9/1978 | Verini | H01Q 1/3258 | 248/539 |
| 6,331,838 | B1 * | 12/2001 | Scott | H01Q 1/085 | 343/715 |
| 7,303,320 | B1 * | 12/2007 | Ashley | B60Q 1/0483 | 248/121 |
| 8,441,401 | B2 * | 5/2013 | Steinkamp | H01Q 1/1214 | 343/713 |
| 8,511,526 | B2 * | 8/2013 | Schellens | B60Q 1/2611 | 224/282 |
| 9,162,628 | B2 * | 10/2015 | Schellens | B60Q 1/2611 | |
| 9,403,476 | B2 * | 8/2016 | Hausler | B60Q 1/0041 | |
| 9,553,357 | B2 * | 1/2017 | Taeger | H01Q 1/1214 | |
| 2009/0303142 | A1 * | 12/2009 | Lerchner | H01Q 1/1214 | 343/713 |
| 2011/0025568 | A1 * | 2/2011 | Totani | H01Q 1/1242 | 343/713 |

(Continued)

*Primary Examiner* — Adriana Figueroa
(74) *Attorney, Agent, or Firm* — Hartman Titus PLC; John D. Titus

(57) ABSTRACT

A third brake light antenna adapter includes an antenna base attached to a spacer that is installed between the vehicle third brake light and the third brake light opening. The spacer is provided with gaskets, substantially identical to the OEM third brake light gaskets, which provide weatherproof seals between the spacer and the vehicle and between the spacer and the third brake light. Special support brackets enable the spacer to grip the inside of the vehicle passenger compartment to hold it securely to the vehicle without extensive modifications to the vehicle structure itself.

10 Claims, 4 Drawing Sheets

(56) References Cited

U.S. PATENT DOCUMENTS

| | | | | |
|---|---|---|---|---|
| 2015/0244067 | A1* | 8/2015 | Nakada | H01Q 1/3275<br>343/713 |
| 2016/0225268 | A1* | 8/2016 | DeBusk | H01Q 1/1207 |

* cited by examiner

THIRD BRAKE LIGHT ANTENNA MOUNT

BACKGROUND OF THE INVENTION

Prior art means for attaching an auxiliary communications antenna (CB radio, Satellite, etc.) to a vehicle consist of a magnetic base, clamp or similar temporary mount, which requires the coaxial cable from the radio to the antenna to be routed through the vehicle door or window to the antenna. This often leads to wind noise and/or water leakage through the door or window seal. Moreover, the ubiquitous temporary magnetic base antenna mount is becoming less and less universal as a result of the increasing use of non-ferromagnetic materials such aluminum and carbon fiber composites in vehicle construction. Permanent non-magnetic antenna installations require modification of (e.g. drilling holes in) the vehicle, which can also lead to water leakage if not done correctly, and requires irreversible modifications to the vehicle, which can reduce resale value.

SUMMARY OF THE INVENTION

A third brake light antenna mount in accordance with the present invention solves the foregoing problems by providing an antenna mount attached to a spacer that is installed between the vehicle third brake light and the third brake light opening. This enables the antenna cable to be routed through the existing third brake light aperture in the vehicle to the antenna mount. The spacer is provided with gaskets, substantially identical to the OEM third brake light gaskets, which provide weatherproof seals between the spacer and the vehicle and between the spacer and the third brake light. Specialty reinforcements enable the spacer to grip the inside of the vehicle passenger compartment to hold it securely to the vehicle without extensive modifications to the vehicle structure itself.

BRIEF DESCRIPTION OF THE DRAWING

The present invention will be better understood from a reading of the following detailed description, taken in conjunction with the accompanying drawing figures in which like references designate like elements and, in which.

DETAILED DESCRIPTION

Figure 1:
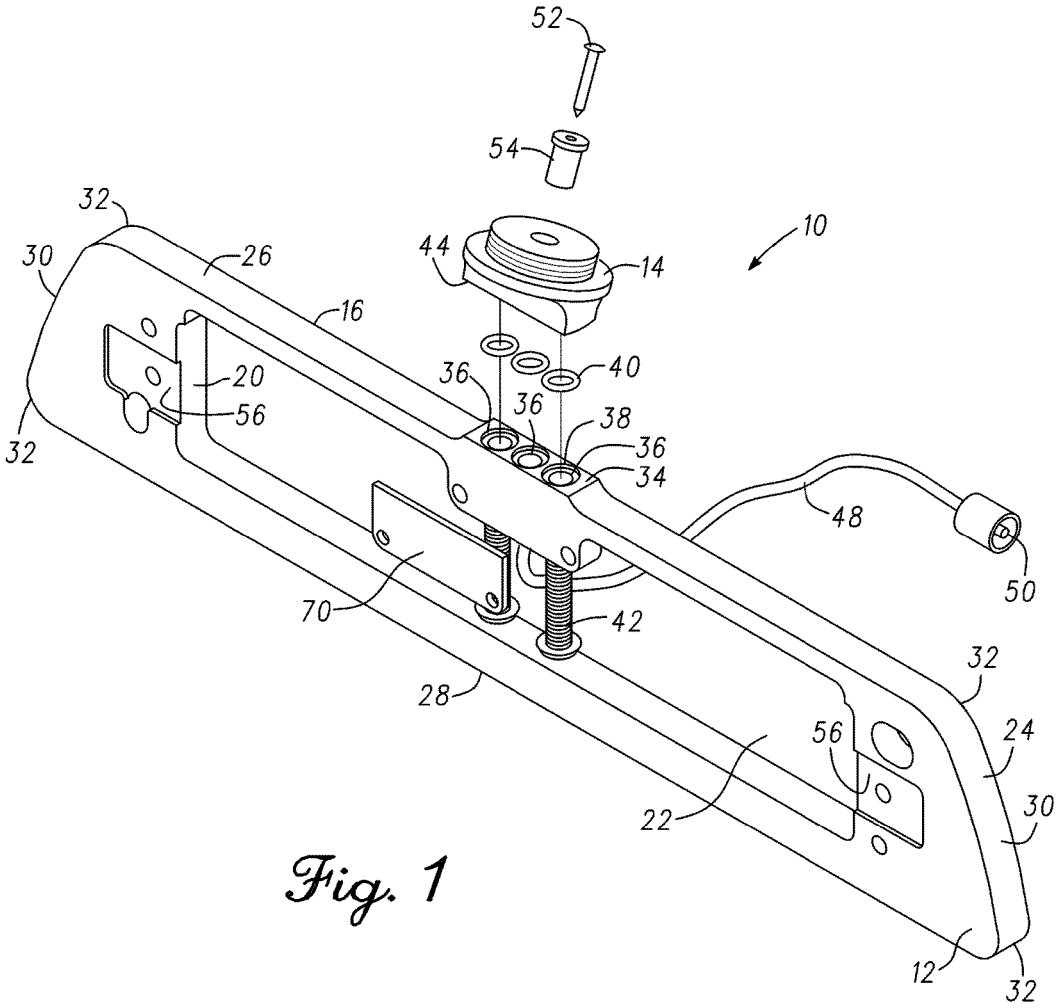
FIG. 1 is a rear perspective view of an antenna adapter incorporating features of the present invention.

The drawing figures are intended to illustrate the general manner of construction and are not necessarily to scale. In the detailed description and in the drawing figures, specific illustrative examples are shown and herein described in detail. It should be understood, however, that the drawing figures and detailed description are not intended to limit the invention to the particular form disclosed, but are merely illustrative and intended to teach one of ordinary skill how to make and/or use the invention claimed herein and for setting forth the best mode for carrying out the invention.

Figure 2:
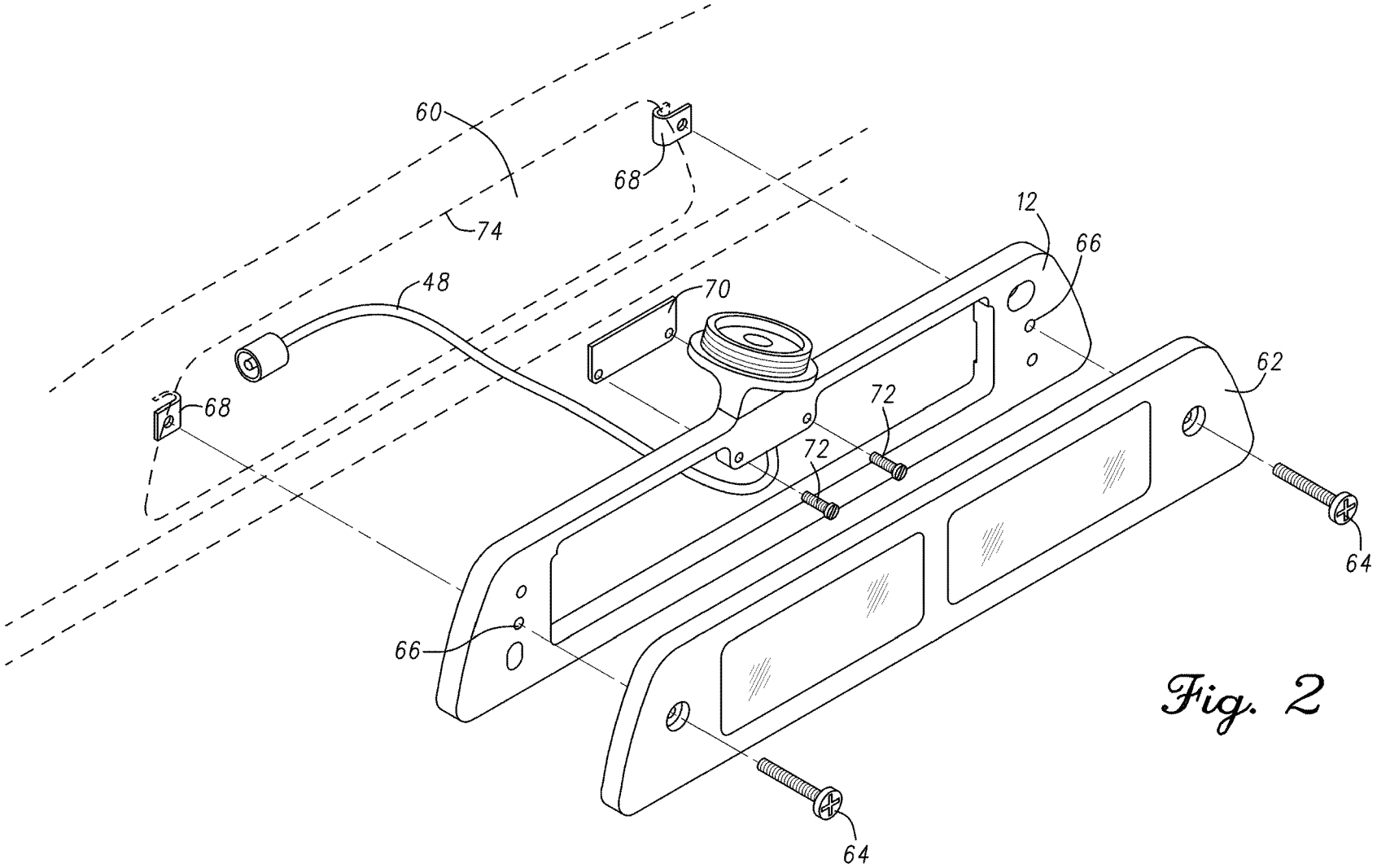
FIG. 2 is a front perspective view of the antenna adapter of FIG. 1.
Figure 3:
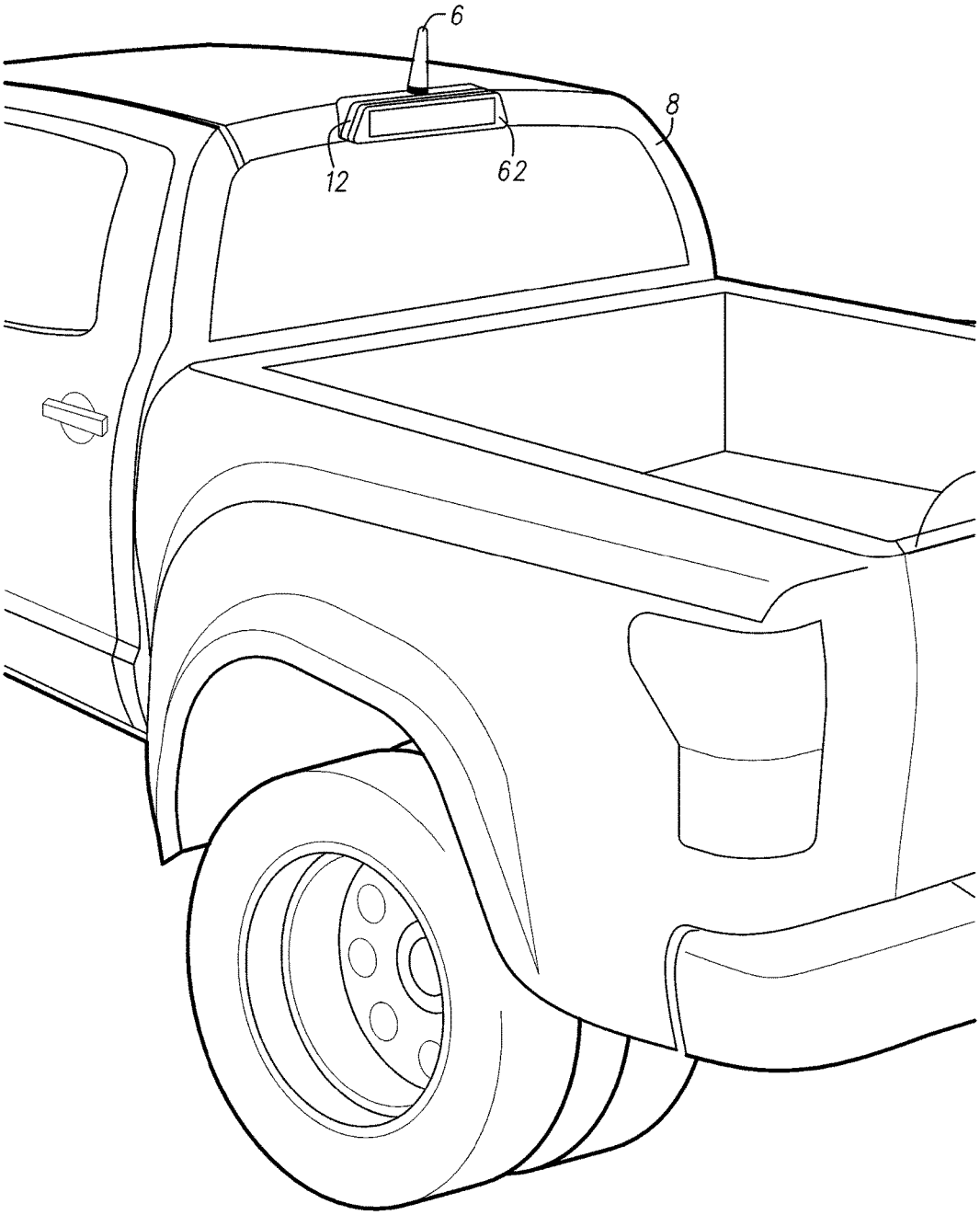
FIG. 3 is; a perspective view of the antenna adapter of FIG. 1 mounted to a vehicle.

With reference to the figures and in particular FIGS. 1-3, an antenna adapter 10, for mounting a communications antenna 6 to the third brake light aperture of a vehicle 8, comprises a spacer 12 and an antenna mount 14. Spacer 12 comprises a hollow .generally rectangular body having a front wall 16, a back wall 18, and an interior wall 20 forming the hollow portion 22 of the hollow rectangular body. Upper wall 26, lower wall 28 and sidewalls 30 are joined by a plurality of curvilinear corners 32 to form the peripheral surface 24 of spacer 12. In the illustrative embodiment, the back wall 18 of spacer 12 includes a pair of recesses 56 which allow spacer 12 to clear the threaded speed nuts of the original equipment third brake light aperture. Spacer 12 can be formed of any suitable conductive material but in the illustrative embodiment is formed from a piece of CNC machined aluminum.

A raised mounting boss 34 extends upward from upper wall 26. In the illustrative embodiment raised mounting boss 34 includes three apertures 36 that extend into hollow portion 22. Apertures 36 include counter-board portions 38 each of which receives a seal 40, which in the illustrative embodiment comprise conventional AS type O-rings. Antenna mount 14 is secured to raised mounting boss 34 by a plurality of threaded fasteners 42, which are threaded from inside hollow portion 22 into corresponding threaded apertures formed in the lower portion 44 of antenna base 14. The central of the three apertures 36 is sized to allow an antenna cable 48 to pass through and attach to antenna base 14 with the central conductor 50 of antenna cable 48 making electrical contact with down lead contact 52 while insulator 54 insulates down lead contact 52 from the remainder of antenna mount 14.

With particular reference to FIG. 2, spacer 12 is assembled to the original equipment third brake light aperture 60 by first removing the original equipment third brake light assembly 62. Spacer 12 is temporarily assembled to the original equipment brake light aperture 60 using the original equipment threaded fasteners 64 which are inserted through mounting holes 66 which are sized and positioned to line up with the original equipment mounting holes 68 surrounding the original equipment third brake light aperture 60. A support bracket 70 is loosely attached to spacer 12 by threaded fasteners 72, which do not line up with any of the original equipment mounting holes 66. Spacer 12, with support bracket 70 is positioned so that support bracket 72 passes completely through the opening and is positioned behind the back side of the original equipment third brake light aperture 60. Spacer 12 is then secured in place temporarily by original equipment threaded fasteners 64 with antenna cable 48 inserted through the original equipment third brake light aperture 60 to connect with a transmitter/receiver (not shown). Once secured by original equipment threaded fastener 64, spacer 12 is additionally secured by tightening threaded fasteners 72 so that the upper edge 74 of the brake light aperture 60 is clamped firmly between support bracket 70 and the back wall 18 of spacer 12.

Original equipment threaded fasteners 64 are then removed, however, because spacer 12 is clamped firmly in place, the alignment between mounting holes 66 and mounting holes 68 is not disturbed. Original equipment third brake light assembly 62 may then be installed simply by reconnecting the bulb leads and re-inserting original equipment threaded fasteners 64 through mounting holes 66. Support bracket 70 thus provides the dual function of providing necessary load-spreading support so that spacer 12 will support the additional load of a communications antenna, and it provides the necessary support so that spacer 12 will remain aligned with mounting holes 66 when original equipment threaded fasteners 64 are removed. As used herein, "communications antenna" means and refers to any type of antenna for receiving and/or transmitting communications signals including radio, television, satellite or other communications signals.

Figure 4:
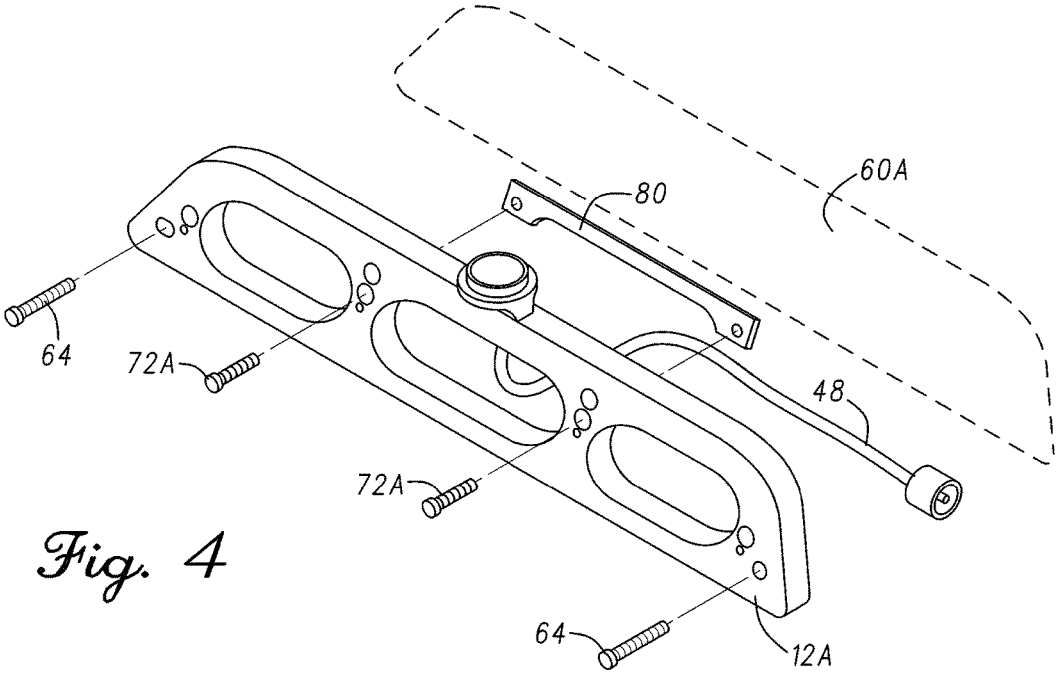
FIG. 4 is a front perspective view of an alternative embodiment of an antenna adapter incorporating features of the present invention.

In an alternative embodiment as shown in FIG. 4, support bracket 80 comprises a flat tab having a substantially U-shaped profile as opposed to the flat rectangular tab shape of support bracket 70. In applications where original equipment third brake light aperture 60 has one or more vertical ribs, spacer 12A is first secured to original equipment third brake light aperture 60 as before using original equipment threaded fasteners 64. Support bracket 80 is then threaded in behind the vertical rib of the brake light aperture and attached to spacer 12A using threaded fasteners 72A. The original equipment fasteners 64 are removed and the third brake light housing reinstalled. As with the illustrative embodiment of FIGS. 1-2, support bracket 80 holds spacer 12A in place and provides the additional load-spreading support necessary for spacer 12A to support a communications antenna.

Figure 5:
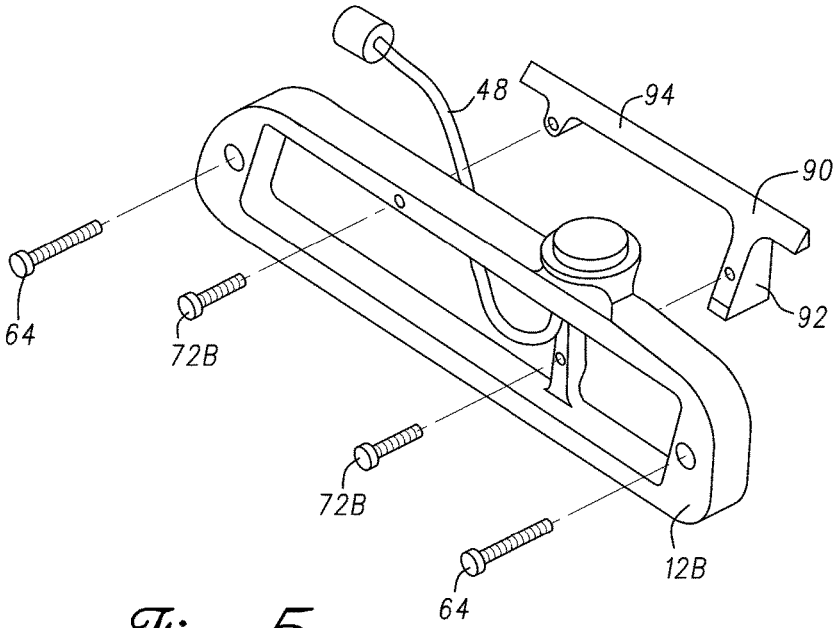
FIG. 5 is a front perspective view of another alternative embodiment of an antenna adapter incorporating features of the present invention.

In another alternative embodiment as shown in FIG. 5, support bracket 90 comprises a solid body having a wedge-shaped section 92 extending laterally outward from a small deep triangular prism section 94. In applications where it is not feasible to capture the upper edge 74 of brake light aperture 60 with a flat tab, support bracket 90 is capable of extending inside the aperture to capture the upper edge 74. As with the prior embodiments, spacer 12B is secured to original equipment third brake light aperture 60 using original equipment threaded fasteners 64. Support bracket 90, attached to spacer 12B by one of the threaded fasteners 72B, is then rotated upward to hook upper edge 74 of brake light aperture 60. The second of threaded fasteners 72B is attached to support bracket 90 and both fasteners tightened to pinch upper edge 74 between support bracket 90 and spacer 12B. The original equipment fasteners 64 are removed and the third brake light housing reinstalled. As with the prior embodiments, support bracket 90 holds spacer 12B in place and provides the additional load-spreading support necessary for spacer 12B to support a communications antenna.

Although certain illustrative embodiments and methods have been disclosed herein, it will be apparent from the foregoing disclosure to those skilled in the art that variations and modifications of such embodiments and methods may be made without departing from the invention. Accordingly, it is intended that the invention should be limited only to the extent required by the appended claims and the rules and principles of applicable law. Additionally, as used herein, references to direction such as "up" or "down" are intended to be exemplary and are not considered as limiting the invention and, unless otherwise specifically defined, the terms "generally," "substantially," or "approximately" when used with mathematical concepts or measurements mean within ±10 degrees of angle or within 10 percent of the measurement, whichever is greater. As used herein, a step of "providing" a structural element recited in a method claim means and includes obtaining, fabricating, purchasing, acquiring or otherwise gaining access to the structural element for performing the steps of the method. As used herein, the claim terms are to be given their broadest reasonable meaning unless a clear disavowal of that meaning appears in the record in substantially the following form ("As used herein the term _____ is defined to mean _____")

What is claimed is:

1. An antenna adapter for attaching a communications antenna to an original equipment third brake light aperture on a vehicle equipped with an original equipment third brake light, which is attached to the vehicle by original equipment mounting holes, the antenna mount comprising:

a spacer comprising a generally oblong body having a front wall, a back wall and an interior wall forming a hollow portion, the spacer further comprising an outer peripheral surface, the peripheral surface comprising an upper wall, a lower wall and a pair of side walls joined by a plurality of curvilinear corners such that the peripheral surface matches the outer contour of the original third brake light aperture, the peripheral surface comprising a mounting boss extending outward therefrom, the mounting boss having a surface adapted to receive an antenna base, the spacer further comprising an aperture for receiving an antenna cable passing from the antenna base into the hollow portion of the oblong body, the spacer further comprising a plurality of through-holes that match the mounting holes for the original equipment third brake light; and a support bracket, the support bracket comprising a bracket member having at least one opening for receiving a threaded fastener, the support bracket sized and shaped so that when the support bracket is attached to the spacer by means of the threaded fastener, the support bracket extends to cover at least a portion of an inside surface of the original equipment third brake light aperture of the vehicle, whereby the spacer is attached to the vehicle by clamping the inside surface of the original equipment third brake light aperture between the spacer and the support bracket and by threading a plurality of fasteners through the plurality of through holes into the original equipment mounting holes.

2. The antenna adapter of claim 1, further comprising, an antenna base mounted to the mounting boss, the antenna base comprising a threaded base formed of an electrically conductive material, an insulator supported by the antenna base and a downlead contact formed of an electrically conductive material passing through the insulator.

3. The antenna adapter of claim 2, wherein:

one of the mounting boss and the antenna base includes counterbored grooves for receiving an O-ring seal.

4. The antenna adapter of claim 1, wherein:

the spacer comprises at least two mounting holes passing through from the front wall to the back wall, the mounting holes in the spacer aligned with two mounting holes of the original equipment third brake light aperture.

5. The antenna adapter of claim 4, wherein:

the spacer comprises at least four mounting holes passing through from the front wall to the back wall, wherein two of the at least four mounting holes are not aligned with mounting holes of the original equipment third brake light aperture.

6. The antenna adapter of claim 2, wherein:

the support bracket comprises a flat, substantially rectangular tab.

7. The antenna adapter of claim 2, wherein:

the support bracket comprises a body having a first triangular prism portion extending laterally from a second triangular prism portion.

8. The antenna adapter of claim 2, wherein:

the support bracket comprises a flat, shallow substantially U-shaped tab.

9. The antenna adapter of claim 1, wherein:

the spacer engages the outer surface of the original equipment third brake light aperture only.

10. An antenna adapter for attaching a communications antenna to an original equipment third brake light aperture on a vehicle equipped with an original equipment third brake light, which is attached to the vehicle by original equipment mounting holes, the antenna mount comprising:

a spacer comprising a generally oblong body having a front wall, a back wall and an interior wall forming a hollow portion, the spacer further comprising an outer peripheral surface, the peripheral surface comprising an upper wall, a lower wall and a pair of side walls joined by a plurality of curvilinear corners such that the peripheral surface covers the outer contour of the original third brake light aperture, the spacer further comprising a mounting boss extending outward therefrom, the mounting boss having a surface adapted to receive an antenna base, the spacer further comprising a plurality of through-holes for securing the spacer over the original equipment third brake light aperture; and at least one support bracket, the at least one support bracket comprising a bracket member having at least one opening for receiving a threaded fastener, the at least one support bracket sized and shaped so that when the at least one support bracket is attached to the spacer by means of the threaded fastener, the spacer extends to cover at least a portion of an outside surface of the original equipment third brake light aperture of the vehicle, whereby the spacer is attached to the vehicle in a fixed position by threading at least one of a plurality of fasteners through the at least one support bracket, and by threading at least one of the plurality of fasteners through at least one of the plurality of through-holes into at least one of the original equipment mounting holes.

* * * * *